United States Patent [19]

O'Neill

[11] Patent Number: 4,693,372

[45] Date of Patent: Sep. 15, 1987

[54] TAPED BAG CHAIN WITH CASSETTE

[75] Inventor: Ronan R. O'Neill, Varese, Italy

[73] Assignee: W. R. Grace & Co., Cryovac Div., Duncan, S.C.

[21] Appl. No.: 806,909

[22] Filed: Dec. 9, 1985

[30] Foreign Application Priority Data

Jun. 14, 1985 [GB] United Kingdom ..... 8515097

[51] Int. Cl.[4] ..... B65D 75/42

[52] U.S. Cl. ..... 206/554; 206/460

[58] Field of Search ..... 206/554, 820, 460; 383/37; 53/473, 459, 384

[56] References Cited

U.S. PATENT DOCUMENTS

| | | | |
|---|---|---|---|
| 3,331,182 | 7/1967 | Hannon | 53/459 |
| 3,587,843 | 6/1971 | Wing | 383/37 X |
| 4,076,122 | 2/1978 | Hall | 206/554 X |
| 4,553,369 | 11/1985 | Debes et al. | 53/55 |

FOREIGN PATENT DOCUMENTS

| | | |
|---|---|---|
| 1240371 | 7/1971 | United Kingdom . |
| 2064477B | 6/1981 | United Kingdom . |

*Primary Examiner*—James F. Coan

*Attorney, Agent, or Firm*—John J. Toney; William D. Lee, Jr.; Mark B. Quatt

[57] ABSTRACT

A bag chain for feeding packaging bags to a bag loader includes bags 2a,2b,2c imbricated and carried by a pair of parallel carrier tapes 3 and 4 which are wound up on spools 8 and 9 of a cassette 5. Loading the bag chain is a bag indexing drive unit involves simply placing the cassette 5 into position with the spools 8 and 9 engaged with parallel drive dogs 11 and 12, after which operation of a drive motor 15, driving the dogs 11 and 12 through a differential unit 14–22 indexes the bags 2a,2b,2c . . . and winds up the tapes 3 and 4. Upon complete consumption of the bag chain, the cassette can be removed and replaced by a fresh cassette with the tapes outside the cassette and carrying the imbricated bags.

3 Claims, 1 Drawing Figure

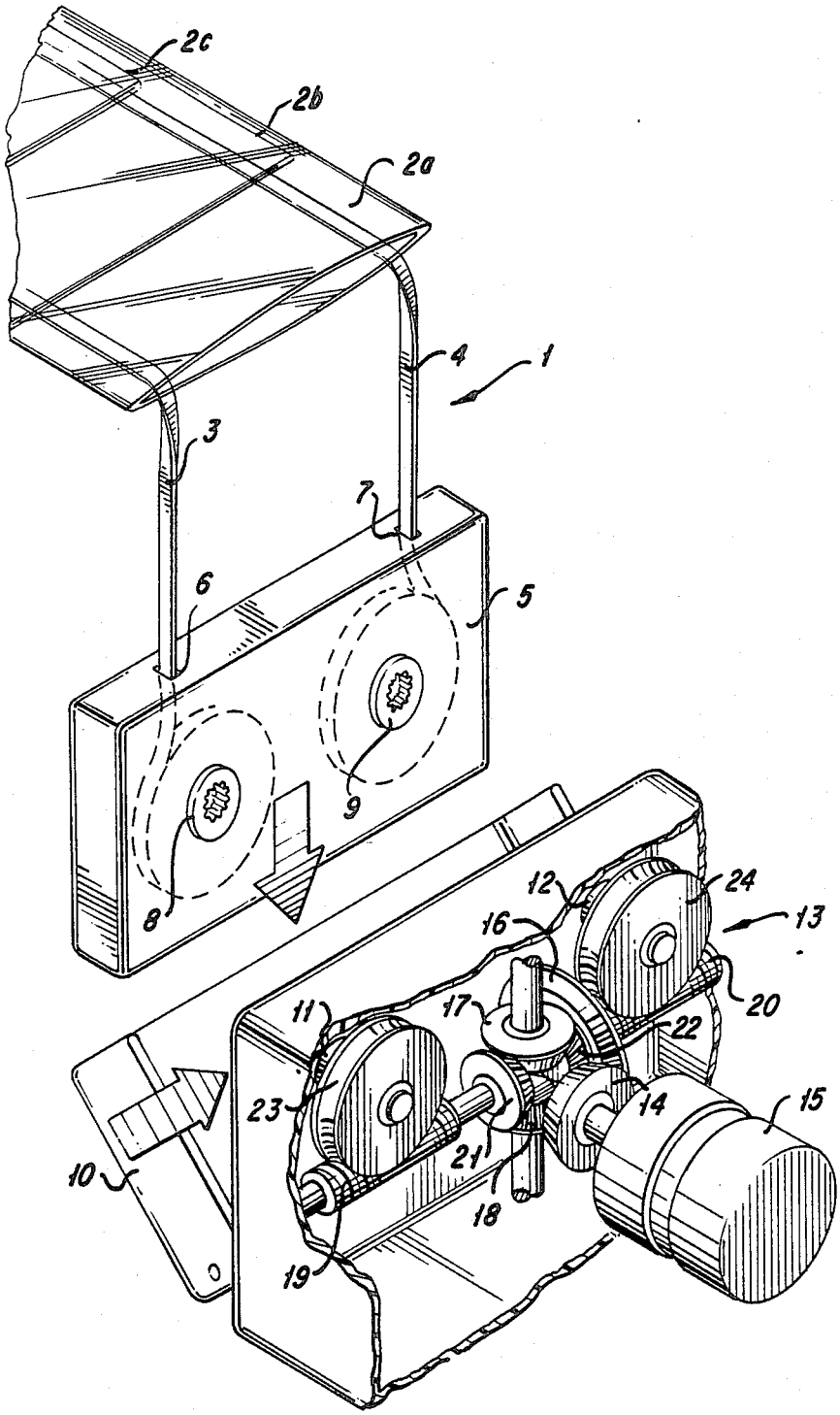
2c
2b
2a
4
1
3
7
6
5
9
8
12
24
13
16
20
11
17
22
23
14
15
21
10
18
19

TAPED BAG CHAIN WITH CASSETTE

The present invention relates to a chain of taped, imbricated bags, suitable for packaging. For example, meat cuts or poultry may be loaded into the bags.

The use of taped imbricated bags has been known for many years and the most commonly available form of these bags uses two separate adhesive carrier tapes which have an imbricated array of the bags placed on the tapes in such a way that the adhesive face of each tape contacts the exposed part of each bag in the imbricated array. Normally the lead bag of the array is attached to the tapes by its end at which the mouth is disposed. Such a tape system is disclosed in British Patent Specification No. 1,240,371 in conjunction with a cassette into which the lead ends of the two tapes were introduced. The tapes are pressed with their adhesive faces in contact with one another and this combined tape was then wound around the spool inside the cassette. During feeding of the chain of bags to the bag loader, the tapes were progressively pressed together and wound-up on the spool until, at the end of the chain of bags in question, the spool was full of the combined tape assembly and could be romoved from the machine and replaced by a fresh spool with a new bag chain attached. Such a cassette system was ideally suited for a bag loader in which the tapes were continuously advanced towards a point of pressing together, from which point onwards the tapes were handled as a single non-adhesive assembly (by virtue of the adhesive faces being in contact with one another).

An alternative proposal for taped imbricated bag chains is disclosed in our British Pat. No. 2,064,477B in which the tapes do not converge but remain parallel to one another and are wound-up on coaxial spools between which a differential drive system is positioned. In such a system the tension in the two tapes can be equal, whereas in the above-mentioned cassette application where the two tapes are pressed into face-to-face adhesive contact the tension in one tape could drop to zero and all the bag-advancing tension could then be transmitted by the other tape with consequent loss of alignment of the bags unless the operator intervened to equalise the length of the tapes.

The advantages of the differential drive system disclosed in British Pat. No. 2,064,477B could only be achieved with the penalty of needing to attach the tapes manually onto the coaxial wind-up spools.

It is an object of the present invention to provide a cassette system in the context of a bag loader in which the taped bags are advanced to the loading station by means of a drive unit incorporating differential drive.

A first aspect of the present invention provides a method of loading a bag chain on a bag loader, comprising taking a bag chain incorporating a succession of imbricated packaging bags on two supply tapes from which they are removed during the loading operation, the supply tapes having lead ends equipped with tape-winding rotors which are supported on spacing means to hold them with substantially parallel axes of rotation; attaching the tape-winding rotors to parallel drive shafts of a bag indexing drive unit; operating the bag indexing drive unit to bring each of the imbricated bags successively to a loading position where the bag is loaded and separated from the tapes; and, after separation of most or all of the bags from the tapes, removing the tape-winding rotors and spacing means from the bag indexing drive unit and replacing them by a fresh pair of tape-winding rotors and spacing means with imbricated taped bags already attached.

A second aspect of the present invention provides a bag chain comprising: a succession of imbricated bags; a pair of side-by-side spaced tapes each having an adhesive face; a pair of tape-winding rotors, each attached to a respective one of the tapes for engagement with a tape-winding drive to wind-up the tapes on the drive; and spacer means supporting the two tape-winding rotors upon substantially parallel axes of rotation, for engagement with parallel axis drive shafts of a tape-winding unit.

A third aspect of the invention provides a bag chain comprising: a succession of imbricated bags; a pair of side-by-side spaced tapes each having an adhesive face; a cassette releasably mountable in a tape winding drive unit; a pair of tape-winding rotors in said cassette, each said rotor being attached to a respective one of the tapes and adapted for engagement with a respective tape winding drive shaft of the tape-winding drive unit to wind-up the tapes on the rotors and said tape-winding rotor having spaced apart substantially parallel axes of rotation.

A fourth aspect of the invention provides a bag chain indexing drive unit comprising: a drive input shaft; a pair of spaced apart parallel tape indexing drive shafts each adapted for engagement with a respective tape-winding rotor of a bag chain; and a differential drive unit between the input shaft and said tape-indexing drive shafts to allow equalisation of tension between the tapes attached to respective tape-winding rotors to be associated with the tape-indexing drive shafts.

In order that the present invention may more readily be understood there now follows a brief description, merely by way of example, with reference to a single drawing showing a partly cut away perspective view of one embodiment of a bag chain and drive unit in accordance with the present invention.

In the drawing, a bag chain generally designated 1 comprises an array of imbricated bags *2a, 2b, 2c* . . . placed on two parallel carrier tapes 3 and 4 having their adhesive faces uppermost on the horizontal run of each tape. The leading ends of the tapes 3 and 4 are introduced into a cassette 5 by way of respective inlet openings 6 and 7, respectively. In this particular case the adhesive face of tape 3 is the one nearer to the observer as it passes into the cassette inlet opening 6, and the adhesive face of the tape 4 is the one further from the observer, in each case the adhesive faces being directed radially outwardly when the tapes are attached to respective wind-up spools 8 and 9.

The two wind-up spools 8 and 9 are floatingly mounted in the cassette 5 so that when the cassette is placed inside a housing for it, defined by a cover 10, each of the spools 8 and 9 can become centered on a respective drive dog 11 and 12 of a cassette drive unit 13.

The drive unit 13 comprises an input bevel gear 14 on a drive shaft from a motor 15, and engaging a first vertical bevel gear 16 which carries two idler gears 17 and 18 for rotation about a horizontal axis coincident with the longitudinal axes of two worms 19 and 20. In practice the first vertical bevel gear 16 is freely rotatably mounted around the shaft of the righthand worm gear 20.

The two idler gears 17 and 18 are in constant mesh with a lefthand vertical bevel gear 21 fast with the worm 19, and a righthand vertical bevel gear 22 fast with the worm 20.

The lefthand worm 19 drives a pinion 23 fast with the drive dog 11 of a drive shaft for the lefthand wind-up spool 8 of the cassette 5, whereas the righthand worm 20 drives a pinion 24 fast with the drive dog 12 of a drive shaft for the righthand wind-up spool 9 of the cassette 5.

From the above description, it will be clear that when the motor 15 rotates, provided the tensions in that when the motor 15 rotates, provided the tensions in the two tapes 3 and 4 are equal, the two wind-up spools 8 and 9 will be driven at the same rate of rotation, but in opposite directions of movement (by virtue of appropriate choice of the hand of the two worms 19 and 20 and their pinions 23 and 24, respectively).

When either one of the tapes slackens, the wind-up spool of the other tape slows down, by virtue of the differential mechanism permitted by free rotation of the two idler bevel gears 17 and 18. Thus in normal operation the two bevel gears 17 and 18 are non-rotatable about their own axes (while orbiting around the horizontal common axis of the first vertical bevel gear 16 and the two coaxial worms 19 and 20), but when the differential is effective there will be some rotation of the two idler gears 17 and 18 in addition to their orbiting.

If desired, the cassette 5 may include some means for coding in response to the particular type of bag attached to the chain of which the cassette forms part, so that simply introducing that cassette into the housing defined by the cover 10 will automatically instruct the bag loading equipment as to which type of bag is involved.

Furthermore, it is envisaged that the cassette will be stored, for example during shipping, with the leading part of each of the tapes wound in so that the leading edge of the first bag 2*a* is substantially against that surface of the cassette 5 in which the openings 6 and 7 are formed, and then before the cassette is loaded into the machine, it will be pulled away from the lead bag 2*a* so as to uncoil part of each of the tapes 3 and 4 to provide the necessary length of tape between the cassette and the lead bag when the cassette is loaded in the bag loader. Such a system is not possible with the prior art cassette of our British Pat. No. 1,240,371, because of the adhesive face-to-face contact of the two tapes at the point where they enter the cassette.

Alternatively each of the tapes 3 and 4 may have a non-adhesive leader portion.

Thus the cassette in accordance with the present invention provides a much improved way of holding the bags during shipping.

More importantly, the fact that the two wind-up spools 8 and 9 are freely floating in the cassette 5 allows these spools to be accurately centered on their drive dogs 11 and 12 so that in use of the bag chain 1 the spools 8 and 9 will always be positively engaged on the drive dogs 11 and 12.

Another advantage of the cassette in accordance with the present invention is that it provides a much more rapid way of threading up a bag chain when used with the twin spool differential drive system. It is necessary only to locate the cassette in register with the two drive dogs 11 and 12, and then to press the cassette onto the drive dogs and to close the cover 10 to complete the loading operation, assuming that the bags 2*a*, 2*b*, 2*c* . . . are sitting on the loading table in the appropriate position.

In the light of this advantage, it will be realised that the cassette 5 serves as a support means to hold the wind up rotors or spools 8 and 9 ready for rapid mounting on and disconnection from the drive dogs 11 and 12. It is therefore not essential to have a completely enclosed cassette 5 around the spools 8 and 9.

It is of course possible for the cassette illustrated in the drawings to be used with a direct drive rather than a differential drive, although the differential drive form is preferred.

In use of the cassette, once one bag chain has been depleted and all or almost all of the bags have been removed from the tapes 3 and 4, the drive motor 15 is operated to retract the exposed ends of the tapes 3 and 4 into the cassette 5, following which the full cassette can be removed and replaced by a fresh, empty cassette already has just been removed can then either be scrapped or processed for removal of the wound-up tape and for re-use of the cassette.

The coding of the cassette may be achieved in any one of several ways, only a few of which include colour coding of the cassette, or the provision of coding cutouts or tabs on the body of the cassette, or printing on the cassette, or a label attached to the cassette. Normally the product identification is marked on the box enclosing the bag chain, so once the bag chain has been removed from the box the product identification may be lost. However, the cassette 5 remains attached to the tapes and consequently there is always a secure indication of the product identification. Besides, as indicated earlier, the use of coding apertures or tabs on the cassette can assist in instructing the bag loading machine automatically as regards the machine adjustments which may be necessary on changing from one bag type to another.

An advantage of the rapid loading facility offered by the present invention is that the bag loading machine may now have a fixed bag chain support table whereas, hitherto, the more cumbersome bag loading operation has required the availability of at least one spare bag trolley system to allow a bag chain to be attached to the trolley and to have its tapes threaded through the intermeshing gear wheels which press the tapes together in adhesive face-to-face contact so that it is then merely necessary to roll this trolley up to the bag loader when a change of bag chain is needed.

Yet a further advantage of the twin spool system in accordance with the present invention is that there is no risk of damage to the operator or to the bag chain during the loading operation, as is possible with the drive gears used in the prior art systems requiring separation of the gears and threading of the two tapes in face-to-face contact between the gears before again face-to-face contact between the gears before again bringing the gears into mesh.

As suggested above, instead of having an enclosed cassette for the tapes, it is of course possible with the method of the present invention to simplify the bag loading operation simply by providing any form of bag tape-driving rotor attached to the lead end of a tape, or to a non-adhesive leader attached to the beginning of the tapes, with means for holding the two rotors in substantially the correct centre-to-centre spacing for rapid connection of the rotors to the drive of the bag indexing unit.

I claim:

1. A bag chain comprising: a succession of imbricated bags; a pair of side-by-side spaced tapes each having an adhesive face; a cassette releasably mountable in a tape winding drive unit; a pair of tape-winding rotors in said cassette, each said rotor being attached to a respective one of the tapes and adapted for engagement with a respective tape winding drive shaft of the tape-winding drive unit to wind-up the tapes on the rotorsdrive and said tape-winding rotor having spaced apart substantially parallel axes of rotation.

2. A bag chain according to claim 1, wherein the tape-winding rotors comprise wind-up spools floatingly supported in the cassette.

3. A bag chain according to claim 1 or claim 2, and including coding means on the cassette for engagement with sensor means of the bag chain indexing drive unit with which the cassette is intended to be used, for adjustment of the bag chain indexing drive unit in response to the particular type of bag in the chain incorporating the cassette.

* * * * *